US007218084B2

(12) United States Patent
Pons et al.

(10) Patent No.: US 7,218,084 B2
(45) Date of Patent: May 15, 2007

(54) INTEGRATED CIRCUIT WITH MODULABLE LOW DROPOUT VOLTAGE REGULATOR

(75) Inventors: Alexandre Pons, Fontaino (FR); Fabienne Grigis, Notre-Dame de l'Osier (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 11/179,782

(22) Filed: Jul. 12, 2005

(65) Prior Publication Data

US 2006/0049812 A1 Mar. 9, 2006

(30) Foreign Application Priority Data

Jul. 15, 2004 (FR) ..... 04 07853

(51) Int. Cl.
*G05F 1/00* (2006.01)

(52) U.S. Cl. ..... 323/274; 323/273; 323/280

(58) Field of Classification Search ..... 323/274, 323/273, 272, 270, 280, 281
See application file for complete search history.

(56) References Cited

U.S. PATENT DOCUMENTS 6,246,221 B1 * 6/2001 Xi ..... 323/280
6,465,994 B1 * 10/2002 Xi ..... 323/274
6,518,737 B1 * 2/2003 Stanescu et al. ..... 323/280
6,700,360 B2 * 3/2004 Biagi et al. ..... 323/280
6,703,815 B2 * 3/2004 Biagi ..... 323/280
6,703,816 B2 * 3/2004 Biagi et al. ..... 323/280
6,765,374 B1 7/2004 Yang et al.
2003/0178978 A1 9/2003 Biagi et al.

FOREIGN PATENT DOCUMENTS

EP 0 403 942 12/1990
EP 1 061 428 12/2000

OTHER PUBLICATIONS

French Preliminary Search Report dated Mar. 2, 2005 for French Application No. 04 07853.

* cited by examiner

*Primary Examiner*—Bao Q. Vu
(74) *Attorney, Agent, or Firm*—Lisa K. Jorgenson; Jon A. Gibbons; Fleit, Kain, Gibbons, Gutman, Bongini & Bianco P.L.

(57) ABSTRACT

A low dropout voltage (LDO) regulator comprises an output stage (EtS) of the amplifier (AMP), which has a main output and n auxiliary outputs which can respectively deliver a main control voltage ($V_{GPRINC}$) and n auxiliary control voltages ($V_{G1}, \ldots, V_{Gn}$); and a power stage (EtP) which has a main power transistor (PmosPrinc), controlled at its gate by the main control voltage ($V_{GPRINC}$), and p power modules (module 1, . . . , module n) of identical layout with p less than or equal to n, respectively having p auxiliary power transistors (PMos1, . . . , PMosn) each controlled at their gate by p auxiliary control voltages ($V_{G1}, \ldots, V_{Gn}$). The number p is selected as a function of an intended maximum output current.

12 Claims, 3 Drawing Sheets

INTEGRATED CIRCUIT WITH MODULABLE LOW DROPOUT VOLTAGE REGULATOR

CROSS-REFERENCE TO RELATED APPLICATIONS

This application is based upon and claims priority from prior French Patent Application No. 04 07853, filed on Jul. 15, 2004 the entire disclosure of which is herein incorporated by reference.

FIELD OF THE PRESENT INVENTION

The present invention generally relates to low dropout voltage regulators and, more particularly, to a production of a power stage of a low dropout voltage regulator.

BACKGROUND OF THE PRESENT INVENTION

A voltage regulator uses a reference current source and a supply voltage (battery) to deliver a regulated output voltage, that is to say one which is independent of the variations in the supply voltage.

For reasons of stability, low dropout voltage regulators may be connected to a decoupling capacitor, arranged in parallel with a load to which the regulator delivers a load current via a power transistor fed back to an operational amplifier. The maximum value of the load current depends on the dimensions of the power transistor. With a view to optimization, it is necessary to match these dimensions to the load current. Since the power transistor has a large stray capacitance, the output stage of the operational amplifier should furthermore be matched to the power transistor, and therefore to the maximum load current. Any modification in the value of the maximum load current thus entails changing the power transistor and matching the regulator core comprising the operational amplifier. This technique represents a great time constraint in terms of planning the integrated circuit.

According what is needed is a method and system to over come the problems and constraints encountered in the prior art and to provide a low dropout voltage regulator which modulates the load current.

SUMMARY OF THE PRESENT INVENTION

The present invention modulates the load current delivered by the low dropout voltage regulator without modifying the layout of the integrated circuit.

The present invention includes a power stage with a layout programmable as a function of a load current, and a core comprising an operational amplifier which is identical irrespective of the load current which is programmed.

The present invention provides constant performance irrespective of the load current which is programmed.

The output stage of the regulator of the present invention does not rely on a single large power MOS transistor. In contrast to the prior art, the present invention includes a fixed power part and one or more assembled power modules, the number of modules being a function of the desired maximum output current.

The present invention therefore provides an integrated circuit comprising a low dropout voltage regulator, the regulator comprising an operational amplifier and a power stage which is fed back to the operational amplifier delivers an output current into a load. According to a general characteristic of the present invention, the output stage of the amplifier has a main output and n auxiliary outputs, which can respectively deliver a main control voltage and n auxiliary control voltages. The power stage furthermore has a main power transistor, controlled at its gate by the main control voltage, and p power modules of identical layout with p less than or equal to n, respectively having p auxiliary power transistors each controlled at their gate by p auxiliary control voltages. The number p is selected as a function of an intended maximum output current.

Stated differently, the present invention uses a power stage which is programmable at the layout level of the integrated circuit by using a plurality of power modules, each power module comprising an auxiliary power transistor. These power modules are activated as a function of the desired value of the load current to be delivered by the low dropout voltage regulator.

In the present invention the value of the load current delivered by the regulator is modulated on the basis of a single fixed power part.

According to one embodiment, the output stage has a main output transistor and n identical auxiliary output transistors. A main internal impedance is furthermore connected between the supply voltage and the main output transistor, and n identical auxiliary internal impedances belonging to the power stage are respectively connected between the supply voltage and the n auxiliary output transistors. The layout of the integrated circuit also has a first part incorporating the operational amplifier and its output stage, apart from the n identical auxiliary internal impedances, and a second part formed by an invariant first sub-part comprising the main power transistor and a second sub-part comprising p power modules of identical layout, the layout of each power module also incorporating the auxiliary internal impedance intended to be connected to the auxiliary output transistor which can deliver the control voltage to the auxiliary power transistor contained in this power module.

The addition of auxiliary internal impedances makes it possible to fix the impedance at the mutually unconnected, that is to say non-interconnected, gates of the power transistors. In this way, the characteristics of the regulator such as the bias range and its performance no longer depend on the number p of power modules.

According to one embodiment, the dimensions of the main power transistor are less than the dimensions of the n auxiliary transistors may be identical or different, and the dimensions of the main power transistor are less than the dimensions of the p auxiliary power transistors.

The foregoing and other features and advantages of the present invention will be apparent from the following more particular description of the preferred embodiments of the present invention, as illustrated in the accompanying drawings.

BRIEF DESCRIPTION OF THE DRAWINGS

The subject matter, which is regarded as the present invention, is particularly pointed out and distinctly claimed in the claims at the conclusion of the specification. The foregoing and other features, and advantages of the present invention will be apparent from the following detailed description taken in conjunction with the accompanying drawings in which:

DESCRIPTION OF THE PREFERRED EMBODIMENTS

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

Figure 1:
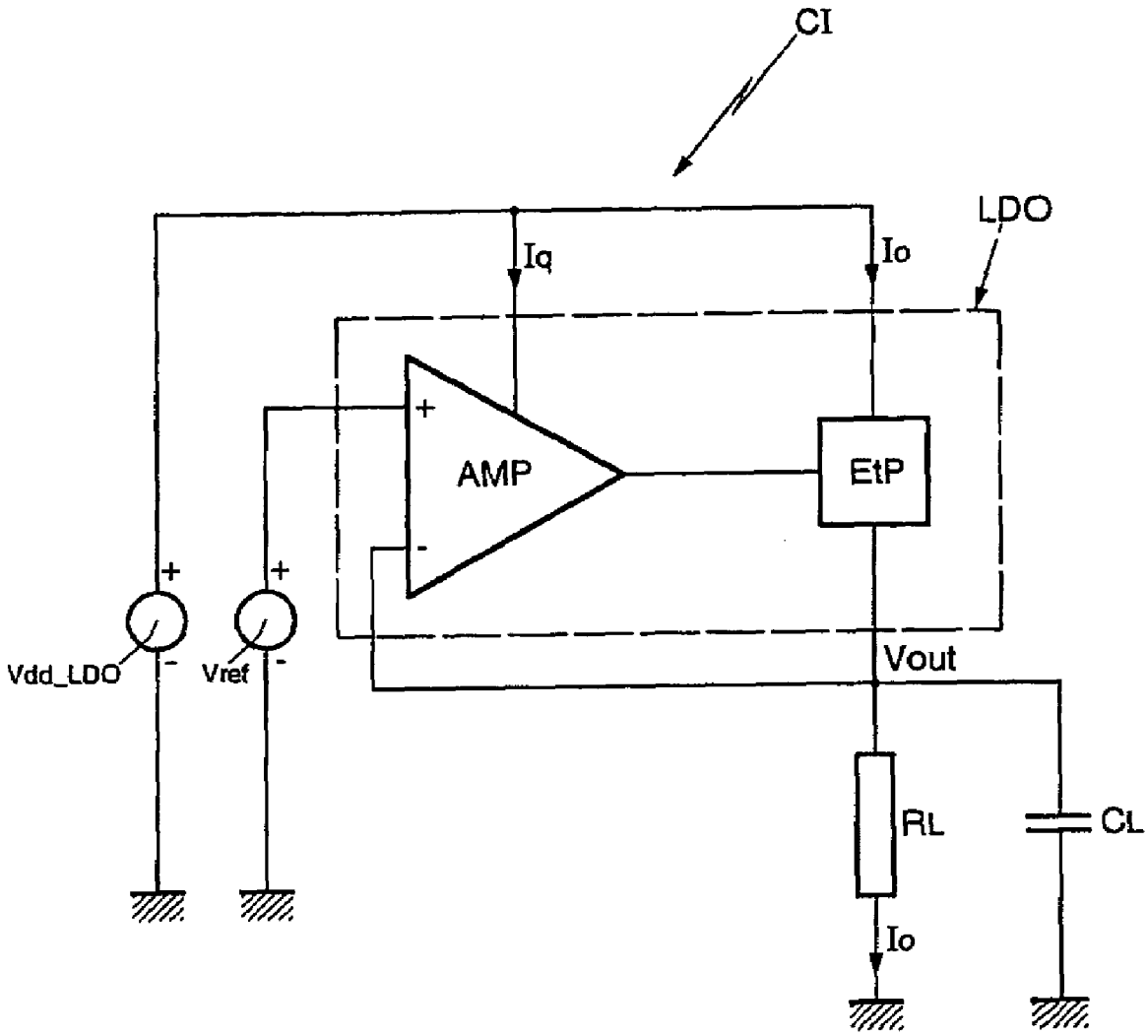
FIG. 1 is a schematic of an embodiment of an integrated circuit according to the present invention.

FIG. 1 represents an integrated circuit IC according to the invention.

The reference LDO represents a low dropout voltage regulator. It comprises an operational amplifier AMP receiving a reference voltage VREF at the positive input. The amplifier AMP is supplied with a supply voltage Vdd_LDO and consumes a current Iq.

The LDO regulator also has a power stage EtP connected to the output of the operational amplifier AMP. The power stage EtP is supplied with the supply voltage Vdd_LDO and delivers an output voltage Vout. The output of the power stage EtP is fed back to the negative input of the operational amplifier AMP and connected to a load RL.

The load RL receives a load current Io equal to the current consumed by the power stage EtP.

The output of the power stage EtP is also connected to a decoupling capacitor CL connected in parallel with the load RL. The capacitor CL generally has a fairly large capacitance, for example 4.7 μF. Its function is to stabilize the low dropout voltage LDO regulator.

Figure 2:
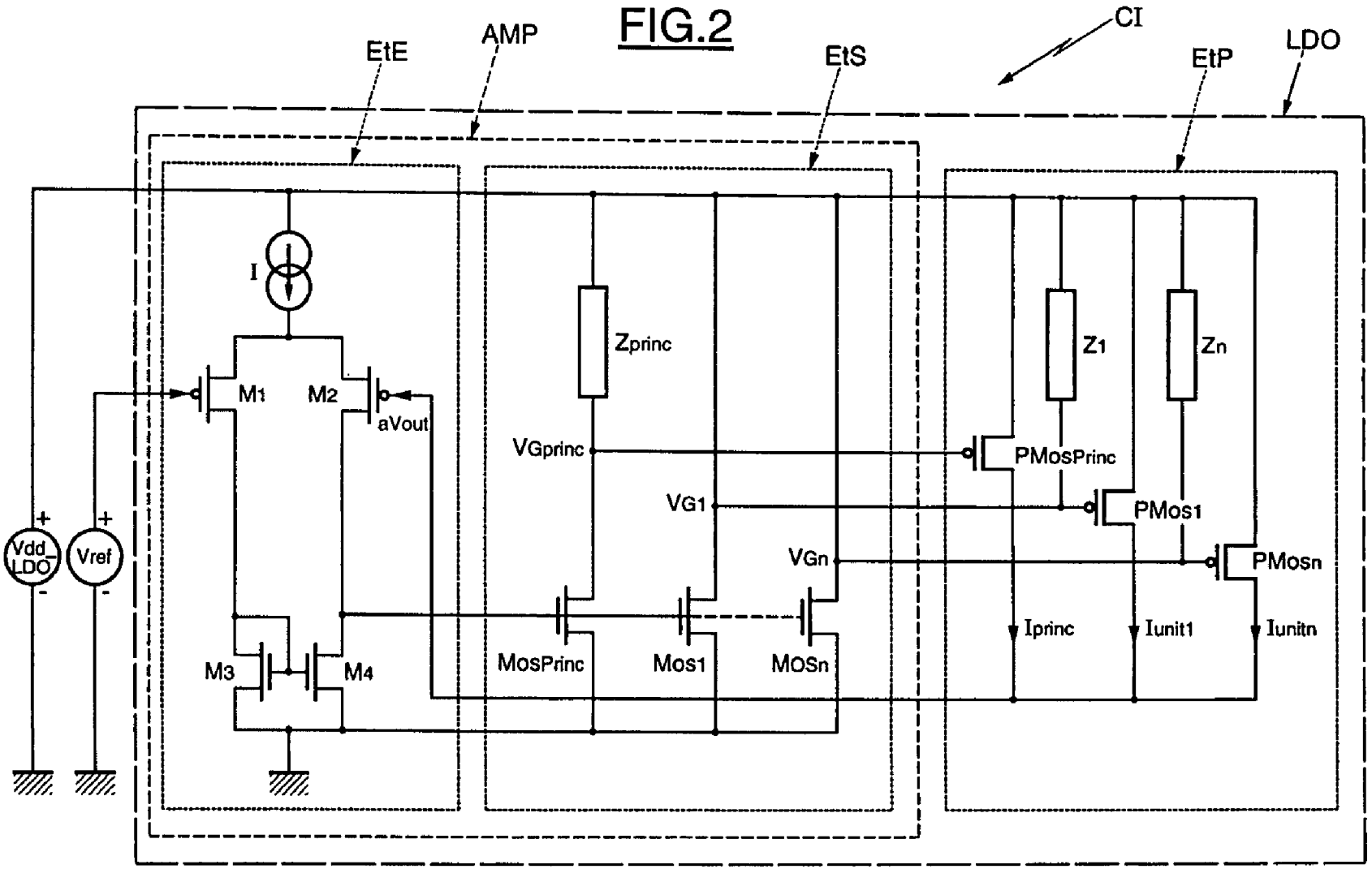
FIG. 2 is a schematic of the low dropout voltage regulator of FIG. 1 according to the present invention.

Reference will now be made to FIG. 2, which represents the LDO regulator in more detail.

The operational amplifier AMP of the LDO regulator here comprises an input stage EtE and an output stage EtS.

The input stage EtE is produced conventionally using a differential pair biased by a current source I and connected to a current mirror. The differential pair comprises two transistors M1 and M2 connected via their source, for example PMOS transistors. The current source I is also connected to the common source of the differential pair. The current mirror is formed by two transistors M3 and M4 connected via their gate, for example NMOS transistors. The common gate of the current mirror is fed back to the source of the transistor M3. Furthermore, the sources of the transistors M3 and M4 are respectively connected to the drains of the transistors M1 and M2 of the differential pair.

The gate of the transistor M1 corresponds to the positive input of the amplifier AMP and therefore receives the reference voltage Vref. The gate of the transistor M2 corresponds to the negative input of the amplifier AMP and receives a voltage aVout proportional to the output voltage Vout of the power stage EtP. The voltage aVout proportional to the output voltage of the power stage EtP is obtained, for example, by means of a divider bridge (not shown) known to the person of average skilled in the art.

The drain of the transistor M2 (output of the input stage EtE) is connected to the output stage EtS of the amplifier AMP.

The output stage EtS of the amplifier AMP comprises a main output transistor MosPrinc connected between the supply voltage Vdd_LDO and earth.

The output stage furthermore comprises n auxiliary output transistors Mos1, . . . Mosn connected in parallel with the main output transistor MosPrinc between the supply voltage Vdd_LDO and the earth of the integrated circuit CI. The gates of the main output transistor MosPrinc and of the auxiliary output transistors Mos1, . . . , Mosn are together connected to the output of the input stage EtE.

A main internal impedance Zprinc is furthermore connected between the supply voltage Vdd_LDO and the drain of the main output transistor MosPrinc.

The drains of the main output transistor MosPrinc and of the auxiliary output transistors Mos1, . . . , Mosn constitute n+1 outputs of the operational amplifier AMP. In this example, all of these n+1 outputs are connected to the power stage EtP and respectively deliver a main control voltage VGPRINC and n auxiliary control voltages VG1, . . . , VGn.

The power stage EtP comprises a main power transistor PMosPrinc connected between the supply voltage Vdd_LDO and the gate of the transistor M2 of the input stage EtE of the operational amplifier AMP. The main power transistor PMosPrinc delivers a current Iprinc.

The power stage EtP furthermore comprises p auxiliary power transistors PMos1, . . . , PMosn. The identical auxiliary power transistors PMos1, . . . , PMosn each deliver a current of the same value Iunit1, . . . , Iunitn. The gates of the main power transistor PMosPrinc and of the p power transistors PMos1, . . . , PMosp are connected to the n+1 output of the power stage EtS. The number of auxiliary power transistors p may be at most equal to n. The number p is determined as a function of the maximum value intended for the load current Io. In this example, p is equal to n.

Furthermore, n identical auxiliary internal impedances Zinterne1, . . . , Zinternen are connected between the supply voltage Vdd_LDO and the gates of the auxiliary output power transistors PMos1, . . . , PMosn. The value of the main internal impedance Zprinc is greater than the value of the auxiliary internal impedances Zinterne1, . . . , Zinternen. The source voltage of the main output transistor MosPrinc of the output stage EtS is therefore greater than the respective source voltages of the auxiliary output transistors Mos1, . . . , Mosn. For example, with a main internal impedance Zprinc three times greater than the value of an auxiliary internal impedance, the source voltage of the main output transistor MosPrinc is ten times greater than the respective drain voltages of the auxiliary output transistors Mos1,. . . Mosn.

In the same way as for the main power transistor PMosPrinc, the auxiliary power transistors PMos1, . . . , PMosn are connected between the supply voltage Vdd_LDO and the gate of the transistor M2 of the input stage EtE of the operational amplifier AMP.

The power transistors are preferably PMOS transistors. Furthermore, the dimensions of the main power transistor PMosPrinc are less than the dimensions of the auxiliary power transistors PMos1, . . . , Pmosn. The dimensions are determined as a function of the values of the currents Iprinc, Iunit1, . . . , Iunitn intended to be delivered.

For example, a main power transistor PMosPrinc delivering a current of between 0 and 1 mA will be selected. The auxiliary power transistors PMos1, . . . , Pmosn will then have dimensions which allow them each to deliver a current Iunit1, . . . , Iunitn lying between 0 and 19 mA (the current in the auxiliary power transistors PMosi starting at 0 mA).

The gate of the main power transistor PMosPrinc is controlled by the main control voltage VGPRINC.

The gates of the auxiliary power transistors PMos1, . . . , Pmosn are controlled by the n auxiliary control voltages VG1, . . . , VGn.

The transistors Mos1, . . . , Mosn of the output stage EtS are always on, and the control voltages VGPRINC, VG1, . . . , VGn allow the main power transistor PMosPrinc and the auxiliary power transistors PMos1, . . . , Pmosn to be on or off. In the case of small currents, therefore, only the power transistor PMosPrinc is on owing to its dimensions. Subsequently, according to the value of the differential voltage at the input stage EtE of the operational amplifier AMP, the auxiliary power transistors PMos1, . . . , Pmosn are turned on and each deliver the same current, which will increase as a function of the demand until reaching the maximum value. In this way, the output current of the LDO regulator can be modulated.

The gate impedance of each auxiliary power transistor PMos1, . . . , PMosn is fixed respectively by the internal impedances Zinterne1, . . . , Zinternen. In this way, and in combination with the fact that the gates of the power transistors are not interconnected, the performance of the LDO regulator is made independent of the number n of auxiliary power transistors.

More specifically, when an internal impedance is connected to each auxiliary output transistor, the pole Le pole of cutoff frequency Fc, which is the first secondary pole of the LDO regulator, seen at each of the gates of the auxiliary power transistors is:

$$Fc = \frac{1}{2*\pi*Z\ int\ ernei*Cg_{PMOSi}},$$

$Cg_{PMOSi}$ representing the stray capacitance for each auxiliary power transistor.

The pole Fc is identical for each of the gates, and independent of n. We therefore have conservation of both the poles and the bias, irrespective of n. More precisely the bias range is $$\left[0;\left(\sqrt{\frac{Iunit}{\beta}}+Vt\right)\Big/Z\ int\ erne\right],$$

and is independent of n.

According to the invention, therefore, the rejection factor of a regulator is independent of n, as is the phase margin of the regulator, which makes it possible to obtain acceptable stability irrespective of the value of n.

Figure 3:
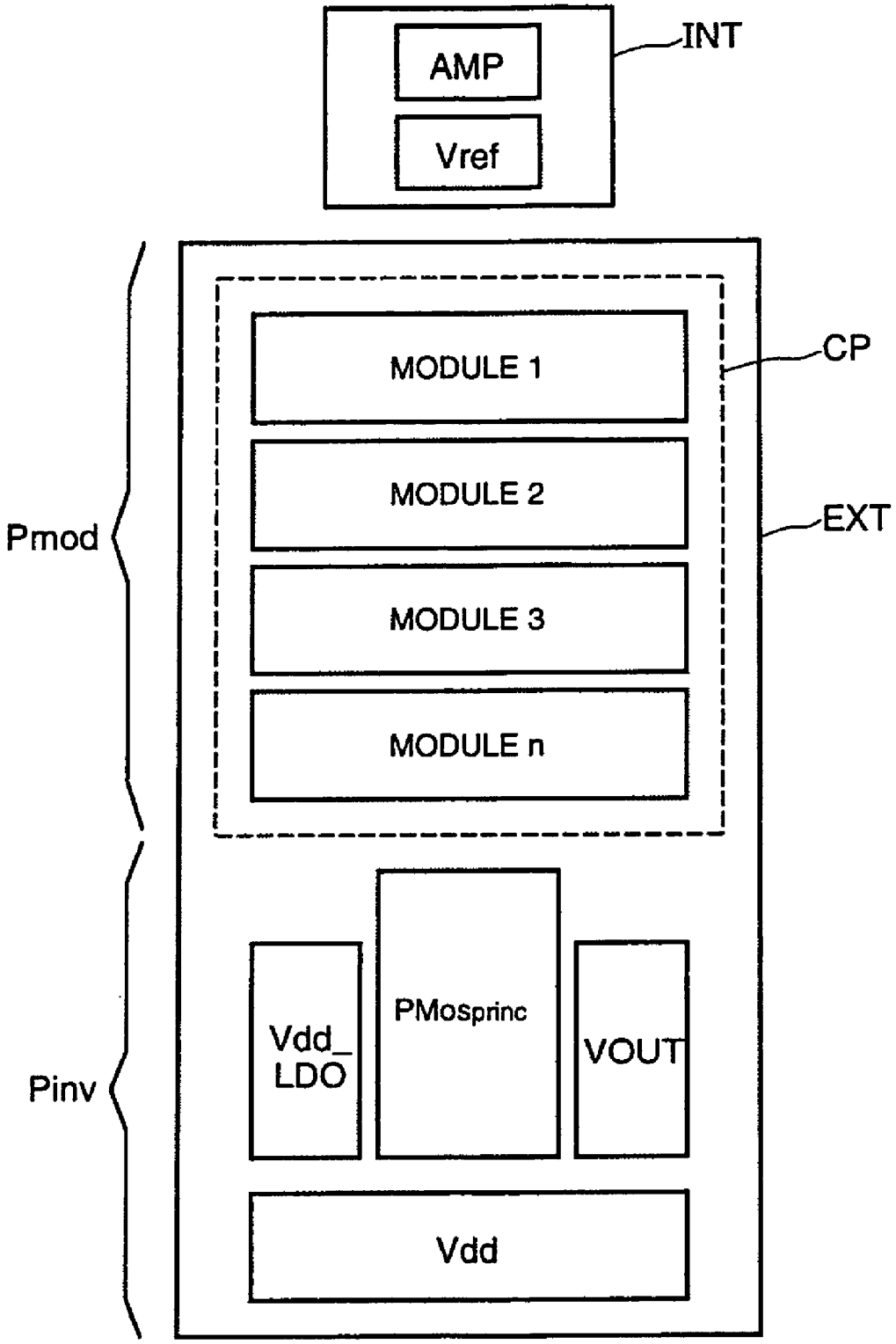
FIG. 3 is a schematic an example of an integrated circuit according to the present invention.

Reference will now be made to FIG. 3, which represents the implementation of the integrated circuit CI described above.

The layout of the integrated circuit CI comprises two separate parts. A first part INT comprising means for generating the reference voltage Vref as well as the operational amplifier AMP, apart from the auxiliary internal impedances Zinterne1, . . . , Zinternen.

A second part EXT comprises two sub-parts. An invariant first sub-part Pinv comprises means for generating the supply voltage Vdd_LDO, a terminal delivering the output voltage Vout of the power stage EtP of the LDO regulator, as well as the supply voltage Vdd of the supply rails. The invariant sub-part Pinv furthermore comprises the main power transistor PMosPrinc, which is on even when the load current Io is small.

The second part EXT also has a modulable sub-part Pmod. This sub-part Pmod comprises n identical and separate power modules module 1, module 2; module 3, . . . , module n. These n power modules comprise the auxiliary power transistors of the power stage EtP of the LDO regulator, as well as the n associated auxiliary internal impedances Zinterne1, . . . , Zinternen.

The n power modules module 1, module 2, module 3, . . . , module n are connected together by a programming cell CP contained in the modulable sub-part Pmod comprising the necessary interconnections (not shown).

The use of a modulable sub-part makes it possible to vary the value of the load current Io delivered by the LDO regulator without modifying the layout of the integrated circuit CI. This is because the integrated circuit CI has the same core irrespective of the load current Io to be delivered, and the module stage can be programmed by means of the n modules. This saves time in designing and planning the integrated circuit.

Furthermore, the fact that the auxiliary internal impedances are included in the power modules makes it possible to reduce the area of silicon used. This also makes it possible to reduce the consumption of the circuit since the drains of the transistors Mos1, . . . , Mosn are inactive when the corresponding auxiliary PMOS is not being used. The reason for this is that the unconnected outputs of the operational amplifier AMP (in the event that p<n) are not associated with an auxiliary internal impedance because these are contained in the power modules.

The circuit as described above is part of the design for an integrated circuit chip. The chip design is created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer transmits the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

The resulting integrated circuit chips can be distributed by the fabricator in raw wafer form (that is, as a single wafer that has multiple unpackaged chips), as a bare the, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Although a specific embodiment of the present invention has been disclosed, it will be understood by those having skill in the art that changes can be made to this specific embodiment without departing from the spirit and scope of the present invention. The scope of the present invention is not to be restricted, therefore, to the specific embodiment, and it is intended that the appended claims cover any and all such applications, modifications, and embodiments within the scope of the present invention.

The invention claimed is:

1. An integrated circuit comprising:

a low dropout voltage (LDO) regulator, the LDO regulator including:

an operational amplifier, wherein the amplifier includes an output stage and a power stage, wherein the output stage includes a main output and up to n auxiliary outputs, wherein the main output deliverers a main control voltage and each of the n auxiliary outputs delivers at least one of n auxiliary control voltages, where n is a positive integer; and wherein the power stage which is fed back to the operational amplifier and delivers an output current when coupled to a load, wherein the power stage has a main power transistor with a gate controlled by the main control voltage, and up to p power modules of identical layout with a number p less than or equal to a number n, and wherein each of the p power modules have an auxiliary power transistor with a gate controlled by one of the n auxiliary control voltages, where p is a positive integer.

2. The integrated circuit of claim 1, wherein the number p is selected as a function of an intended maximum output current.

3. The integrated circuit of claim 1, wherein the output stage includes:

a main output transistor and up to n identical auxiliary output transistors, wherein that a main internal impedance is connected between a supply voltage and the main output transistor;

wherein up to n identical auxiliary internal impedances belonging to the power stage are respectively connected between the supply voltage and each of n auxiliary output transistors.

4. The integrated circuit of claim 3, wherein the LDO regulator is formed in two parts, a first part including the operational amplifier with the output stage and a second part including the n identical auxiliary internal impedances and the main power transistor and the p power modules of identical layout, wherein the layout of each the p power modules incorporating each of the n identical auxiliary internal impedances for electrically connecting with the n auxiliary output transistors which can deliver the control voltage to the n identical auxiliary output transistors contained in the p power modules.

5. The integrated circuit of claim 4, wherein the second part of the LDO regulator is formed in two sub-parts, a first sub-part including the n identical auxiliary internal impedances and a second sub-part including the main power transistor and the p power modules of identical layout.

6. The integrated circuit of claim 4, wherein physical dimensions of the main power transistor are less than physical dimensions of each of the p auxiliary power transistors.

7. The integrated circuit of claim 4, wherein physical dimensions of the main power transistor are less than physical dimensions of each of the n auxiliary transistors.

8. The integrated circuit of claim 4, wherein the auxiliary power transistors has a cut off frequency Fc characterized by:

$$Fc = \frac{1}{2 * \pi * Z\ int\ ernei * Cg_{PMOSi}},$$

where $^{CgPMosi}$ representing a stray capacitance for each auxiliary power transistor and wherein Zint ernie is each of the n internal auxiliary internal impedances.

9. The integrated circuit of claim 8, wherein Fc is identical for each auxiliary power transistor and independent of n.

10. A low dropout voltage regulator, the regulator comprising:

an operational amplifier, wherein the amplifier includes an output stage and a power stage, wherein the output stage includes a main output and up to n auxiliary outputs, wherein the main output deliverers a main control voltage and each of the n auxiliary outputs delivers at least one of n auxiliary control voltages, where n is a positive integer; and wherein the power stage which is fed back to the operational amplifier and delivers an output current when coupled to a load, wherein the power stage has a main power transistor with a gate controlled by the main control voltage, and up to p power modules of identical layout with a number p less than or equal to a number n, and wherein each of the p power modules have an auxiliary power transistor with a gate controlled by one of the n auxiliary control voltages, where p is a positive integer.

11. The low dropout voltage regulator of claim 10, wherein the number p is selected as a function of an intended maximum output current.

12. The low dropout voltage regulator of claim 10, wherein the output stage includes:

a main output transistor and up to n identical auxiliary output transistors, wherein that a main internal impedance is connected between a supply voltage and the main output transistor;

wherein up to n identical auxiliary internal impedances belonging to the power stage are respectively connected between the supply voltage and each of n auxiliary output transistors.

* * * * *